US007803269B2

(12) United States Patent
Kokayeff et al.

(10) Patent No.: US 7,803,269 B2
(45) Date of Patent: Sep. 28, 2010

(54) HYDROISOMERIZATION PROCESS

(75) Inventors: Peter Kokayeff, Des Plaines, IL (US); Laura Elise Leonard, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 294 days.

(21) Appl. No.: 11/872,312

(22) Filed: Oct. 15, 2007

(65) Prior Publication Data

US 2009/0095653 A1 Apr. 16, 2009

(51) Int. Cl.
*C10G 45/58* (2006.01)
*C10G 35/04* (2006.01)
*C07C 5/13* (2006.01)

(52) U.S. Cl. ..... 208/134; 208/133; 208/141; 585/734

(58) Field of Classification Search ..... 208/133, 208/134, 141; 585/734, 735, 737
See application file for complete search history.

(56) References Cited

U.S. PATENT DOCUMENTS

| | | | | |
|---|---|---|---|---|
| 3,130,006 | A | 4/1964 | Rabo et al. | 23/110 |
| 3,668,112 | A | 6/1972 | Parker et al. | 208/89 |
| 3,730,880 | A * | 5/1973 | Van der Toorn et al. | 208/213 |
| 4,363,718 | A | 12/1982 | Klotz | 208/110 |
| 4,419,220 | A | 12/1983 | LaPierre et al. | 208/111 |
| 4,501,926 | A | 2/1985 | LaPierre et al. | 585/739 |
| 4,554,065 | A | 11/1985 | Albinson et al. | 208/59 |
| 4,676,887 | A | 6/1987 | Fischer et al. | 208/61 |
| 4,678,764 | A | 7/1987 | Le et al. | 502/26 |
| 4,683,214 | A | 7/1987 | Angevine et al. | 502/66 |
| 4,689,138 | A | 8/1987 | Miller | 208/111 |
| 4,738,766 | A | 4/1988 | Fischer et al. | 208/68 |
| 4,788,378 | A | 11/1988 | Chang et al. | 585/739 |
| 4,789,457 | A | 12/1988 | Fischer et al. | 208/68 |
| 4,828,677 | A | 5/1989 | Fischer et al. | 208/89 |
| 4,855,530 | A | 8/1989 | LaPierre et al. | 585/739 |
| 4,859,311 | A | 8/1989 | Miller | 208/89 |
| 4,867,862 | A | 9/1989 | Ziemer | 208/27 |
| 4,919,789 | A | 4/1990 | Fischer et al. | 208/61 |
| 4,921,594 | A | 5/1990 | Miller | 208/58 |
| 4,943,366 | A | 7/1990 | Fischer et al. | 208/68 |
| 4,960,504 | A | 10/1990 | Pellet et al. | 208/411 |

(Continued)

FOREIGN PATENT DOCUMENTS

EP 0 225 053 A1 6/1987

(Continued)

OTHER PUBLICATIONS

Schmitz, C. et al, "Deep desulfurization of diesel oil: Kinetic studies and process-improvement by the use of a two-phase reactor with pre-saturator," Chemical Engineering Science, vol. 59, No. 14, 2004, pp. 2821-2829.

(Continued)

*Primary Examiner*—Walter D Griffin
*Assistant Examiner*—Renee Robinson
(74) *Attorney, Agent, or Firm*—James C Paschall

(57) ABSTRACT

A process is provided for improving the cold flow properties of a hydrocarbon stream employing a substantially liquid-phase continuous hydroisomerization zone where the reaction zone has a substantially constant level of dissolved hydrogen throughout without the addition of additional hydrogen external to the reaction zone.

20 Claims, 1 Drawing Sheet

U.S. PATENT DOCUMENTS

| | | | | |
|---|---|---|---|---|
| 4,962,269 | A | 10/1990 | LaPierre et al. | 585/739 |
| 5,082,986 | A | 1/1992 | Miller | 585/667 |
| 5,135,638 | A | 8/1992 | Miller | 208/27 |
| 5,149,421 | A | 9/1992 | Miller | 208/114 |
| 5,246,566 | A | 9/1993 | Miller | 208/27 |
| 5,282,958 | A | 2/1994 | Santilli et al. | 208/111 |
| 5,403,470 | A | 4/1995 | Kokayeff et al. | 208/212 |
| 5,527,448 | A | 6/1996 | Morel et al. | 208/211 |
| 5,718,820 | A | 2/1998 | Morel et al. | 208/15 |
| 5,833,837 | A | 11/1998 | Miller | 208/80 |
| 5,976,351 | A | 11/1999 | Apelian et al. | 208/27 |
| 6,123,835 | A | 9/2000 | Ackerson et al. | 208/213 |
| 6,200,462 | B1 | 3/2001 | Cash et al. | 208/89 |
| 6,294,080 | B1 | 9/2001 | Thakkar et al. | 208/100 |
| 6,428,686 | B1 | 8/2002 | Ackerson et al. | 208/213 |
| 6,444,116 | B1 | 9/2002 | Galiasso et al. | 208/58 |
| 6,497,813 | B2 | 12/2002 | Ackerson et al. | 208/311 |
| 6,638,419 | B1 | 10/2003 | Da Silva et al. | 208/208 R |
| 6,881,326 | B2 | 4/2005 | Ackerson et al. | 208/213 |
| 6,890,425 | B2 | 5/2005 | Ackerson et al. | 208/311 |
| 7,074,320 | B2 | 7/2006 | Miller | 208/27 |
| 7,094,332 | B1 | 8/2006 | Kalnes et al. | 208/97 |
| 7,354,462 | B2 | 4/2008 | O'Rear | |
| 2002/0148755 | A1 * | 10/2002 | Ackerson et al. | 208/209 |
| 2004/0159582 | A1 | 8/2004 | Simmons et al. | |
| 2005/0010076 | A1 | 1/2005 | Wasserscheid et al. | 585/862 |
| 2005/0082202 | A1 | 4/2005 | Ackerson et al. | 208/213 |
| 2006/0144756 | A1 | 7/2006 | Ackerson et al. | 208/108 |

FOREIGN PATENT DOCUMENTS

| | | | |
|---|---|---|---|
| EP | 0 993 498 | B1 | 8/2004 |
| WO | 96/13563 | A1 | 5/1996 |
| WO | 96/26993 | A1 | 9/1996 |

OTHER PUBLICATIONS

Datsevitch, L. et al., "Improvement of the deep desulfurization of diesel fuel by pre-saturation and a recycle of the liquid phase," DGMK Tagungsber., 2003, pp. 321-328, Chemical Abstracts 140(15/16), Abstract No. 255917 (2004).

Gudde, N.J. et al., "Improving deep sulfur removal from motor fuels by the use of a pre-saturator and a liquid circuit," Chemie-lngenieur-Technik, vol. 75, No. 8, 2003, p. 1040, and English language abstract (1 page).

Boesmann, A. et al., "Deep desulfurization of diesel fuel by extraction with ionic liquids," Chem. Commun., vol. 23, 2001, pp. 2494-2495, Chemical Abstracts 136(9/10), Abstract No. 153666 (2002).

Stratiev, D. et al., "Investigation on the effect of heavy diesel fraction properties on product sulphur during ultra deep diesel hydrodesulphurization," Erdol Erdgas Kohle, vol. 122, No. 2, 2006, pp. 59-60, 62-63, Urban Verlag Hamburg/Wien GmbH, Germany.

Gatte, R. et al., "Hydrogen processing. Hydrotreating. General Process.", National Petrochemical and Refiners Association, 1999 NPRA Question and Answer Session on Refining and Petrochemical Technology, Washington, D.C., pp. 140-158.

Johnson, T.E., "Weigh options for meeting future gasoline sulfur specifications," Fuel Technology & Management, vol. 7, No. 2, pp. 16,18 (Mar. 1997).

* cited by examiner

HYDROISOMERIZATION PROCESS

FIELD

The field generally relates to a hydrocarbon conversion process for the improvement of cold flow properties of a hydrocarbonaceous stream and, in particular, a hydroisomerization process to improve cold flow properties of a hydrocarbonaceous stream.

BACKGROUND

Distillates derived from a Fischer-Tropsch process or from the hydroprocessing of vegetable oils can be composed of normal or straight chain paraffins (n-paraffins) in the C8 to C30 range that have relatively high melting points. While these distillates can have excellent cetane numbers, in some cases, however, they also can have poor cold flow properties. For example, such long chain paraffins can crystallize into waxy solids under cold temperatures, which result in the poor flow properties. Cold flow properties of a hydrocarbon stream are often characterized by measuring cloud point, pour point, and cold filter plugging point (CFPP). Such distillates as described above can have high cloud point values of at least about 4.4° C. (40° F.), high pour point values of at least about 4.4° C. (40° F.), and high CFPP values of at least about 4.4° C. (40° F.). In order to improve these properties, the hydrocarbon stream can be subjected to hydroisomerization where the n-paraffins are converted to branched paraffins (iso-paraffins), which have better cold flow properties.

Current hydroisomerization techniques typically employ a three-phase system (gas/liquid/solid catalyst), such as conventional trickle bed technology, to convert n-paraffins into iso-paraffins. In these systems, the continuous phase throughout the reactor is a gas phase, and large amounts of hydrogen gas are generally required to maintain this continuous gas phase throughout the reactors. However, supplying such large supplies of gaseous hydrogen at the operating conditions needed for isomerization adds complexity and expense to the system.

For example, in order to supply and maintain the needed amounts of hydrogen in a continuous gas phase system, the resulting effluent from the hydroisomerization reactor is commonly separated into a gaseous component containing hydrogen and a liquid component. The gaseous component often is directed to a compressor and then recycled back to the reactor inlet to help supply the large amounts of hydrogen gas needed to maintain the continuous gaseous phase therein. Conventional distillate hydroisomerization units typically operate at about 3.45 MPa (500 psig) to about 8.27 MPa (1,200 psig) and, therefore, require the use of a recycle gas compressor in order to provide the recycled hydrogen at the high pressures of the reactor. Often such hydrogen recycle is from about 1,200 to about 5,000 SCF/B, and processing such quantities of hydrogen through a high-pressure compressor adds complexity and cost to the hydroisomerization unit.

On the other hand, while such three-phase systems generally require large amounts of hydrogen to maintain the continuous gas phase, the hydroisomerization reactions typically do not consume significant amounts of hydrogen. While hydrogen is generally needed to effect isomerization, this reaction generally does not consume hydrogen. Some hydrogen may be consumed, however, because a small amount of cracking may also occur in isomerization reaction zones in which hydrogen is consumed. As a result, there tends to be a large excess of hydrogen throughout the isomerization system when conducted in a continuous gas phase that generally is not needed for the isomerization reactions. Such excess hydrogen is typically separated from the resulting effluent streams prior to further processing, which requires additional separation zones and vessels. As discussed above, if this excess hydrogen is recycled to the hydroisomerization inlet to help supply gas to the system, the hydrogen must still be processed through high-pressure compressors in order to supply the hydrogen at the needed high pressures of the reaction vessel. As a result, not only does conventional three-phase hydroisomerization require costly, high-pressure compressors, these systems have an excess of hydrogen that is generally not consumed in the process.

Two-phase hydroprocessing (i.e., a liquid hydrocarbon stream and solid catalyst) also has been proposed in some cases to convert certain hydrocarbonaceous streams into other more valuable hydrocarbon streams. For example, the reduction of sulfur in certain hydrocarbon streams may employ a two-phase reactor with pre-saturation of hydrogen rather than using a traditional three-phase system. See, e.g., Schmitz, C. et al., "Deep Desulfurization of Diesel Oil: Kinetic Studies and Process-Improvement by the Use of a Two-Phase Reactor with Pre-Saturator," Chem. Eng. Sci., 59:2821-2829 (2004). These two-phase systems only use enough hydrogen to saturate the liquid-phase in the reactor. As a result, the reaction systems of Schmitz et al. do not provide for decreasing hydrogen levels due to hydrogen consumption during the reaction process, thus the reaction rate in such systems decreases due to the depletion of the dissolved hydrogen. Hydrodesulfurization is a process that requires large amount of hydrogen and has a large hydrogen consumption to effect the desired sulfur reductions.

Other uses of liquid-phase reactors have been to hydrocrack and hydrotreat hydrocarbonaceous streams. However, hydrotreating and hydrocracking also typically require large amounts of hydrogen to effect their conversions; therefore, a large hydrogen demand is still required even if these reactions are completed in liquid-phase systems. As a result, to maintain such a liquid-phase hydrotreating or hydrocracking reaction and still provide the needed levels of hydrogen, prior liquid-phase systems require the introduction of additional diluents or solvents into the feed to dilute the reactive components of the feed relative to the amount of dissolved hydrogen. As a result, the diluents and solvents provide a larger concentration of dissolved hydrogen relative to the feed to insure adequate conversion rates can occur in the liquid-phase. Larger, more complex, and more expensive liquid-phase reactors are needed in these systems to achieve the desired conversions.

Although a wide variety of process flow schemes, operating conditions and catalysts have been used in commercial petroleum hydrocarbon conversion processes, there is always a demand for new methods and flow schemes that provide more useful products and improved product characteristics. In many cases, even minor variations in process flows or operating conditions can have significant effects on both quality and product selection. There generally is a need to balance economic considerations, such as capital expenditures and operational utility costs, with the desired quality of the produced products.

SUMMARY

In one aspect, a process is provided for improving the cold flow properties of a hydrocarbon feed stream by converting a portion of normal or straight chain paraffins (n-paraffins) to branched paraffins (iso-paraffins) with a reduction in the amount of hydrogen needed in the system to effect such conversions. In this aspect, the process uses a substantially liquid-phase reaction zone to isomerize the hydrocarbon feed stream with a substantial n-paraffin content rather than a three-phase system requiring large amounts of additional high-pressure hydrogen to maintain a continuous gaseous phase in the reactor. The substantially liquid-phase systems herein admix an amount of hydrogen into the hydrocarbon feed stream or at least a portion thereof effective to obtain a substantially constant reaction rate throughout the hydroisomerization zone while maintaining a substantially liquid-phase condition.

The process reduces at least one of the cloud point, pour point, and CFPP value of a hydrocarbon feed stream with the substantially liquid-phase continuous hydroisomerization of the stream. In such aspects, hydrogen is admixed with the hydrocarbon feed stream (or at least a portion thereof) in an amount and in a form effective to provide a substantially constant amount of hydrogen throughout the substantially liquid-phase continuous hydroisomerization zone, while maintaining substantially liquid-phase conditions. In another aspect, hydrogen is admixed with the hydrocarbon feed stream (or at least a portion thereof) in an amount sufficient to saturate the hydrocarbon feed stream with hydrogen and, in another aspect, in an amount in excess of that required to saturate. The hydrocarbon feed stream is then directed to the substantially liquid-phase continuous hydroisomerization zone, without significant (if any) dilution by other hydrocarbonaceous streams. For example, the hydrocarbon feed stream (or at least a portion thereof) is generally without a substantial hydrocarbon content provided from or recycled from the substantially liquid-phase continuous reaction zone. In this zone, the hydrocarbon feed stream (or portion thereof) is reacted with at least a hydroisomerization catalyst and at hydroisomerization conditions to produce an effluent with a significant iso-paraffin content having at least one of a reduced cloud point, a reduced pour point, and a reduced CFPP value relative to the cloud point, pour point, and CFPP value of the hydrocarbon feed stream.

In yet another aspect, the hydrocarbon feed stream (or at least a portion thereof) is admixed with an amount of hydrogen in excess of that required for saturation. In such aspect, the reaction preferably proceeds in the substantially liquid-phase continuous hydroisomerization zone without additional sources of hydrogen external to the reactors. Without such additional sources of hydrogen, the liquid-phase stream in the reactor still has a substantially constant amount of dissolved hydrogen throughout the reaction zone effective to produce a substantially constant reaction rate. In such aspect, as the reactions consume or use dissolved hydrogen, the excess amount of hydrogen in the liquid-phase reaction zone provides additional hydrogen in a continuously available form from a small gas phase entrained or otherwise associated with the liquid-phase. The hydrogen dissolves back into the liquid-phase to maintain the substantially constant level of saturation. In such aspect, the system provides only sufficient additional hydrogen to provide the desired substantially constant isomerization reaction rates and beneficial iso-paraffin content.

In other aspects, the liquid-phase stream with additional gaseous hydrogen therein has a generally constant level of dissolved hydrogen from one end of the reactor zone to the other. Such liquid-phase reactors may be operated at a substantially constant reaction rate to generally provide higher conversions per pass and permit the use of smaller reactor vessels. In another aspect, such conversion and reaction rates allow the liquid-phase continuous reaction zone to operate without a liquid recycle to achieve the desired isomerization of the straight chain paraffin content of the feed stream.

In yet another aspect, the substantially liquid-phase continuous reaction zone also operates without a hydrogen recycle, other hydrocarbon recycle streams (such as, for example, a recycle of the hydroisomerization effluent or recycle of any other hydroisomerized streams), or admixing other hydrocarbons into the hydrocarbon feed stream. In such aspects, sufficient hydrogen can be supplied into the substantially liquid-phase reactor to provide the desired reaction rates and beneficial iso-paraffin content without diluting the reactive components of the feed or adding additional hydrogen into the stream or isomerization zone.

As a result, smaller and less complex reaction systems with less amounts of hydrogen can be employed to obtain the same isomerization conversion rates as obtained in the more complex prior art systems with less wasted, excess hydrogen. In one aspect, the process, therefore, eliminates the need for a costly, high-pressure recycle gas compressor in the reaction zone because the liquid-phase reactors have a smaller hydrogen demand that can be satisfied from a slip stream from the hydrogen make-up system.

Other embodiments encompass further details of the process, such as preferred feed stocks, preferred liquid-phase catalysts, and preferred operating conditions to provide but a few examples. Such other embodiments and details are hereinafter disclosed in the following discussion of various aspects of the process.

DETAILED DESCRIPTION

Figure 1:
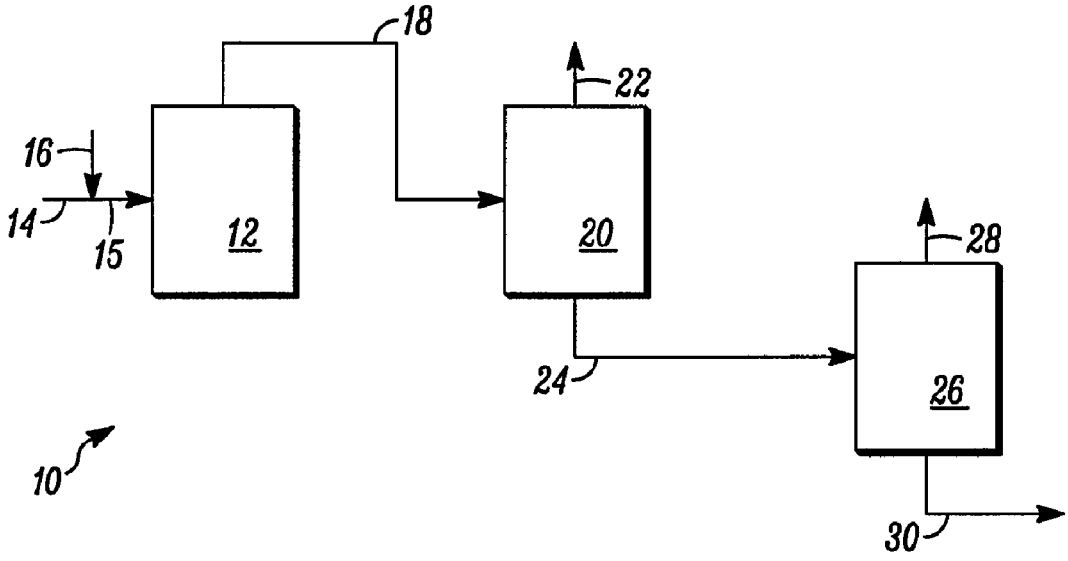
FIG. 1 is an exemplary flowchart of a process to improve the cold flow properties of a hydrocarbon stream.

In one aspect, a suitable hydrocarbon feed stock includes an effluent from a Fischer-Tropsch process or a hydroprocessed vegetable oil that are primarily composed of n-paraffins in the C8 to C30 carbon number range. Suitable feed stocks generally have a boiling point from about 149° C. (300° F.) to about 399° C. (750° F.). Such feed streams can have high cloud point values of at least about 4.4° C. (40° F.), high pour point values of at least about 4.4° C. (40° F.), and high CFPP values of at least about 4.4° C. (40° F.). However, other feed streams, boiling points, and cold flow properties can also be used in the processes herein such as, for example, conventional distillate fuels.

In another aspect, the selected hydrocarbon feed stock or at least a portion of the selected hydrocarbon feed stock is combined with a hydrogen-rich stream while maintaining a liquid-phase condition and then introduced into a substantially liquid-phase continuous hydroisomerization reaction zone. For example, the feed stock (or portion thereof) is introduced into the hydroisomerization reaction zone and contacted with a hydroisomerization catalyst (or a combination of hydroisomerization catalysts) at hydroisomerization conditions effective to convert a portion of n-paraffins into iso-paraffins sufficient to produce an effluent having reduced cold flow properties relative to the cold flow properties of the hydrocarbon feed stock.

For example, the hydroisomerization reaction zone in one aspect converts at least about 10 percent (in another aspect, at least about 50 percent and, in yet another aspect, about 10 to about 90 percent) of the n-paraffins of the hydrocarbon feed stock into iso-paraffins effective to provide an effluent with at least one of a cloud point value of about 0° C. (32° F.) or less, a pour point value of about 0° C. (32° F.) or less, and/or a CFPP value of about 0° C. (32° F.) or or less. In general, such hydroisomerization conditions include a temperature from about 260° C. (500° F.) to about 371° C. (700° F.), a pressure from about 1.38 MPa (200 psig) to about 8.27 MPa (1200 psig), a liquid hourly space velocity of the fresh hydrocarbon feed stock from about 0.1 $hr^{-1}$ to about 10 $hr^{-1}$. However, other hydroisomerization conditions are also possible depending on the particular feed stocks being treated, the compositions of the feed stocks, desired effluent compositions, and other factors.

Suitable hydroisomerization catalysts are any known conventional hydroisomerization catalysts. For example, suitable catalysts can include zeolite components, hydrogenation/dehydrogenation components, and/or acidic components. In some forms, the catalysts can include at least one Group VIII metal such as a noble metal (i.e., platinum or palladium). In other forms, the catalyst may also include silico alumino phosphate and/or zeolite alumino silicate. Examples of suitable catalysts are disclosed in U.S. Pat. Nos. 5,976,351 A, 4,960,504, 4,788,378 A, 4,683,214 A, 4,501,926 A, and 4,419,220 A; however, other isomerization catalysts may also be used depending on the feed stock composition, operating conditions, desired output, and other factors.

In another aspect, the effluent from the substantially liquid-phase hydroisomerization zone is introduced into a separation zone. In one such aspect, the hydroisomerization zone effluent may be first contacted with an aqueous stream or wash water to dissolve any ammonium salts and then partially condensed. The stream may then be introduced into a high pressure vapor-liquid separator typically operating to produce a bleed stream where removal of inert components, such as light hydrocarbon gases, methane, ethane, and the like is removed from the system to prevent accumulation downstream in later processes. The liquid bottoms from the separation zone is then routed to at least a stabilizer zone to further remove any light hydrocarbons (i.e., propane, butane, pentane, and the like) as a flash gas. The bottoms of the stabilizer zone includes the isomerized hydrocarbons having the reduced cold flow properties. This bottoms stream may be directed to a storage tank. By one approach, the high pressure separator operates at a temperature from about 29° C. (85° F.) to about 149° C. (300° F.) and a pressure from about 1.38 MPa (200 psig) to about 8.27 MPa (1200 psig) to separate such streams, and the stabilizer zone operates at a temperature from about 38° C. (100° F.) to about 177° C. (350° F.) and a pressure from about 0.07 MPa (10 psig) to about 1.03 MPa (150 psig) to separate such streams.

In yet another aspect, the hydrocarbon feed stock (or at least a portion thereof) to the substantially liquid-phase continuous hydroisomerization zone is saturated with an amount of hydrogen. Preferably, the hydrogen also is added in an amount in excess of saturation to provide a small gas-phase throughout the reaction zone. In one such aspect, the liquid-phase has an additional amount of hydrogen therein effective to maintain a substantially constant level of dissolved hydrogen throughout the liquid-phase reaction zone as the reaction proceeds.

Thus, as the reaction proceeds and consumes the dissolved hydrogen, there is sufficient additional hydrogen in the small gas phase to continuously provide additional hydrogen to dissolve back into the liquid-phase in order to provide a substantially constant level of dissolved hydrogen (such as generally provided by Henry's law, for example). The liquid-phase, therefore, remains substantially saturated with hydrogen even as the reaction consumes dissolved hydrogen. Such a substantially constant level of dissolved hydrogen is advantageous because it provides a generally constant reaction rate in the liquid-phase reactors or a consistent level of hydrogen consumption.

In one aspect, the amount of hydrogen added to the hydrocarbon feed stock will generally range from an amount to saturate the stream to an amount (based on the operating conditions) where the stream is generally at a transition from a liquid to a gas-phase, but still has a larger liquid-phase than a gas-phase. In one such aspect, for example, the amount of hydrogen will range from about 125 percent to about 150 percent of saturation. In other aspects, it is expected the amount of hydrogen may be up to about 500 percent of saturation and up to about 1000 percent of saturation of the stream. In one such example, at the liquid-phase reaction zone conditions discussed above, it is expected that about 30 to about 800 SCF/B of hydrogen will provide such additional levels of hydrogen to maintain the substantially constant saturation of hydrogen throughout the liquid-phase reactor. This level of hydrogen can be provided by a slip stream from the hydrogen make-up system and, thus, avoids the use of costly, high-pressure recycle gas compressors. In one instance, this level of extra hydrogen also constitutes greater than about 10 percent and, in other instances, greater than about 20 percent of the total volume of the reactor.

In such aspect, the hydrogen may comprise a small bubble flow of fine or generally well dispersed gas bubbles rising through the liquid-phase in the reactor. In such form, the small bubbles aid in the hydrogen dissolving in the liquid-phase. In another aspect, the liquid-phase continuous system may range from the vapor phase as small, discrete bubbles of gas finely dispersed in the continuous liquid-phase to a generally slug flow mode where the vapor phase separates into larger segments or slugs of gas traversing through the liquid. In either case, the liquid is the continuous phase throughout the reactors.

It should be appreciated, however, that the relative amount of hydrogen required to maintain a substantially liquid-phase continuous system, and the preferred additional amounts thereof, is dependent upon the specific composition of the hydrocarbonaceous feed stock, the desired isomerization, the amount of cracking occurring the reaction zone, and/or the reaction zone temperature and pressure. The appropriate amount of hydrogen required will depend on the amount necessary to provide a liquid-phase continuous system, and the preferred additional amounts thereof, once all of the above-mentioned variables have been selected.

In another aspect, the hydrocarbon feed stock to the substantially liquid-phase hydroisomerization zone is preferably substantially undiluted with other hydrocarbon streams prior to the liquid-phase continuous reaction zone. That is, the liquid-phase continuous reaction zone preferably does not have a hydrocarbon recycle (such as, for example, a recycle of the hydroisomerization effluent or recycle of any other hydroisomerized streams), other hydrocarbon streams are not admixed into the hydrocarbon feed stream, and no hydrogen recycle is employed. Dilution of the hydrocarbon feed stream to the liquid-phase reactors is generally not necessary because sufficient hydrogen can be dissolved in an undiluted stream to sufficiently isomerize the hydrocarbons in the feed. As discussed above, diluting, admixing, or blending other streams into the feed to the substantially liquid-phase reactors would decrease the per pass conversion rates. As a result, the substantially undiluted feed provides for a less complex and smaller reactor system.

DETAILED DESCRIPTION OF THE DRAWING FIGURE

Turning to FIG. 1, an exemplary hydrocarbon processing unit to hydroisomerize a hydrocarbon feed stream to reduce cold flow properties is illustrated. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to FIG. 1, an integrated processing unit 10 is provided that includes a substantially liquid-phase continuous hydroisomerization zone 12 to effect a reduction in at least one the cloud point value, pour point value, and CFPP value of a feed stream. In one aspect, the hydrocarbon feed stream, preferably comprising a Fischer-Tropsch distillate or a hydroprocessed vegetable oil, is introduced into the integrated process 10 via line 14. A hydrogen-rich gaseous stream is provided via line 16 and joins the feed stream 14 to produce a resulting admixture that is transported via line 15 to the hydroisomerization zone 12, which preferably reduces at least one the cloud point value to about 0° C. (32° F.) or less, the pour point value to about 0° C. (32° F.) or less, and/or the CFPP value to about 0° C. (32° F.) or less. A resulting effluent stream is removed from hydroisomerization zone 12 via line 18.

The resulting effluent stream 18 may be cooled (not shown) and directed to a high pressure separator zone 20 where a liquid hydrocarbonaceous stream is separated from a bleed stream to remove light hydrocarbon gases such a methane, ethane, and the like. The gas bleed stream is removed from the high pressure separator zone 20 via line 22. The bottoms of the separator zone 20 includes the liquid hydrocarbon stream that is directed via line 24 to a stabilizer zone 26 that further removes any remaining light hydrocarbons (i.e., propane, butane, pentane, and the like) via line 28. The bottoms from the stabilizer zone 26 is removed via line 30 and includes the liquid hydrocarbon stream having the reduced cold flow properties. If desired, this stream may be routed to a storage tank for later use.

In addition, advantages and embodiments of the process and catalyst described herein are further illustrated by the following Example; however, the particular conditions, flow schemes, materials and amounts thereof recited in this example, as well as other conditions and details, should not be construed to unduly limit this method. All percentages are by weight unless otherwise indicated.

EXAMPLE

A hydrocarbon feed stock having about 95 percent nC14 to nC16 hydrocarbons as detailed in Table 1 below was separately hydroisomerized in a substantially liquid-phase continuous reactor and a gas phase continuous reactor in order to compare the effluent compositions from both reactors. Each reactor included a hydroisomerization catalyst comprising a noble metal on an acidic support.

TABLE 1

Feedstock composition

| Feed Component | Weight % |
|---|---|
| nC11 | 0.01 |
| nC12 | 0.02 |
| nC13 | 0.19 |
| nC14 | 31.7 |
| nC15 | 50.7 |
| nC16 | 12.9 |
| nC17 | 2.75 |
| nC18 | 0.54 |
| nC19 | 0.12 |
| nC20 | 0.04 |
| nC21 | 0.02 |
| nC22 | 0.01 |

The feed stock of Table 1 was reacted at the conditions of Table 2 to produce an effluent having the characteristics of Table 3. At the conditions of the substantially liquid-phase continuous reactor in this Example, the amount of hydrogen in the reactor was about 600 percent in excess of that required to saturate the hydrocarbon feed stock.

TABLE 2

Reactor Conditions

| | Substantially Liquid Phase Continuous | Gas Phase Continuous Trickle Bed |
|---|---|---|
| Pressure, psig | 500 | 495 |
| Temperature, ° F. | 590 | 600 |
| LHSV, $hr^{-1}$ | 1.0 | 1.0 |
| $H_2$/hydrocarbon Feed, SCF/B | 202 | 1985 |

TABLE 3

Effluent Characteristics

| Effluent Composition Characteristic | Substantially Liquid Phase Continuous | Gas Phase Continuous Trickle Bed |
|---|---|---|
| nC14 to nC16 Yield, wt % | 37.4 | 38.9 |
| iC14 to iC16 Yield, wt % | 52.1 | 52.0 |
| iC14 to iC16/(nC14 to nC16) | 1.39 | 1.34 |
| nC14 to nC16 Conversion*, % | 60.8 | 59.2 |
| iC14 to iC16 Selectivity Ratio** | 89.9 | 92.0 |

*$\text{Conversion}_{nC14\ to\ nC16} = (\text{Feed}_{nC14\ to\ nC16} - \text{Effluent}_{nC14\ to\ nC16})/(\text{Feed}_{nC14\ to\ nC16})$

**Selectivity Ratio = $(100 \times \text{Effluent}_{iC14\ to\ iC16}/\text{Feed}_{nC14\ to\ nC16})/(\text{Conversion}_{nC14\ to\ nC16})$ In this example, the conditions of the substantially liquid-phase continuous reactor produced an effluent with approximately the same yields, conversion, and selectivity ratio as that obtained from the traditional gas phase continuous trickle bed reactor but with about 90 percent less hydrogen used to effect such conversion levels. It will be appreciated, however, that the effluent composition, yields, conversion levels, and selectivity ratio may vary depending on the feedstock composition, catalysts, reaction conditions, and other variables.

The foregoing description and Example clearly illustrates the advantages encompassed by the processes described herein and the benefits to be afforded with the use thereof. In addition, FIG. 1 is merely intended to illustrate but one exemplary flow scheme of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

What is claimed is:

1. A process for improving the cold flow properties of a hydrocarbon stream, the process comprising:

providing a hydrocarbon feed stream having a cloud point, a pour point, and a CFPP value;

taking at least a portion of the hydrocarbon feed stream as a hydroprocessing feed;

admixing an amount of hydrogen with the hydroprocessing feed, the hydrogen in a form available for substantially consistent consumption in the substantially liquid-phase continuous hydroisomerization zone;

directing the hydroprocessing feed to the substantially liquid-phase continuous hydroisomerization zone; and reacting the hydroprocessing feed undiluted with another hydrocarbon stream in the substantially liquid-phase continuous hydroisomerization zone using at least a hydroisomerization catalyst at hydroisomerization conditions effective to produce an effluent having at least one of a reduced cloud point, a reduced pour point, and a reduced CFPP value relative to the cloud point, pour point, and CFPP value of the hydrocarbon feed stream.

2. The process of claim 1, wherein the reaction proceeds in the substantially liquid-phase continuous hydroisomerization zone without additional sources of hydrogen external to the liquid-phase continuous hydroisomerization zone.

3. The process of claim 2, wherein the substantially liquid-phase continuous hydroisomerization zone has a substantially constant amount of dissolved hydrogen throughout the reaction zone effective to produce a substantially constant reaction rate.

4. The process of claim 1, wherein the amount of hydrogen admixed with the hydroprocessing feed is in excess of that required for saturation of the hydroprocessing feed.

5. The process of claim 4, wherein the amount of hydrogen admixed with the hydroprocessing feed is up to about 1000percent over that required for saturation of the hydroprocessing feed.

6. The process of claim 5, wherein the hydrogen is provided from a make-up hydrogen system.

7. The process of claim 1, wherein the hydrocarbon feed stream has a cloud point of 4.4° C. (40° F.) or greater, a pour point of 4.4° C. (40° F.) or greater, and a CFPP value of 4.4° C. (40° F.) or greater.

8. The process of claim 1, wherein the effluent has a cloud point of 0° C. (32° F.) or less, a pour point of 0° C. (32° F.) or less, and a CFPP value of 0° C. (32° F.) or less.

9. A process for improving the cold flow properties of a hydrocarbon stream, the process comprising:

providing a hydrocarbon feed stream having a cloud point, a pour point, and a CFPP value;

admixing an amount of hydrogen with the hydrocarbon feed stream, the hydrogen in a form available for substantially consistent consumption in a liquid-phase continuous reaction zone;

directing the hydrocarbon feed stream undiluted with another hydrocarbonaceous stream to a substantially liquid-phase continuous hydroisomerization zone; and reacting the undiluted hydrocarbon feed stream in the substantially liquid-phase continuous hydroisomerization zone using at least a hydroisomerization catalyst at hydroisomerization conditions effective to produce an effluent having at least one of a reduced cloud point, a reduced pour point, and a reduced CFPP value relative to the cloud point, pour point, and CFPP value of the hydrocarbon feed stream.

10. The process of claim 9, wherein the amount of hydrogen admixed with the hydrocarbon feed stream is in excess of that required for saturation of the hydrocarbon feed stream.

11. The process of claim 10, wherein the amount of hydrogen admixed with the hydrocarbon feed stream is up to about 1000percent over that required for saturation of the hydrocarbon feed stream.

12. A process for improving the cold flow properties of a hydrocarbon stream having a substantial n-paraffin content, the process comprising:

providing a hydrocarbon feed with a boiling range from about 149° C. (300° F.) to about 399° C. (750° F.) having a cloud point, a pour point, and a CFPP value;

admixing an amount of hydrogen with the hydrocarbon feed in excess of that required for saturation of the hydrocarbon feed;

directing the hydrocarbon feed undiluted with another hydrocarbon stream to a generally liquid-phase continuous hydroisomerization zone; and reacting the undiluted hydrocarbon feed in the generally liquid-phase continuous hydroisomerization zone over a hydroisomerization catalyst effective to produce an effluent having an increased iso-paraffin content and at least one of a reduced cloud point, a reduced pour point, and a reduced CFPP value relative to the cloud point, the pour point, and the CFPP value of the hydrocarbon feed.

13. The process of claim 12, wherein the generally liquid-phase continuous hydroisomerization zone has a substantially constant amount of dissolved hydrogen throughout the reaction zone effective to produce a substantially constant reaction rate.

14. The process of claim 12, wherein the amount of hydrogen admixed with the hydrocarbon feed is up to about 1000percent over that required for saturation of the hydrocarbon feed.

15. The process of claim 12, wherein the hydrogen is provided by a slip stream from a make-up hydrogen system.

16. The process of claim 12, wherein the effluent from the substantially liquid-phase hydroisomerization zone is directed to a separation zone to separate a gaseous hydrocarbon stream from a liquid hydrocarbon stream.

17. The process of claim 16, wherein the liquid hydrocarbon stream is directed to a stabilization zone to remove lower boiling point hydrocarbon products from an isomerized liquid hydrocarbon stream.

18. The process of claim 12, wherein the substantially liquid-phase hydroisomerization zone operates without a recycle gas compressor.

19. The process of claim 12, wherein the hydrocarbon feed comprises n-paraffins in the range of C8to C30and with a cloud point of 4.4° C. (40° F.) or greater, a pour point of 4.4° C. (40° F.) or greater, and a CFPP value of 4.4° C. (40° F.) or greater.

20. The process of claim 12, wherein at least about 50percent of the n-paraffin content is substantially isomerized to iso-paraffins in the C8to C30range.

* * * * *